United States Patent [19]

Bloomquist et al.

[11] Patent Number: 4,644,721

[45] Date of Patent: Feb. 24, 1987

[54] GRILLE FASTENER SYSTEM AND METHOD OF USING THE SAME

[75] Inventors: Eric R. Bloomquist; Rajiv K. Dhital, both of Minneapolis, Minn.

[73] Assignee: Rasmussen Millwork, Inc., St. Paul, Minn.

[21] Appl. No.: 798,463

[22] Filed: Nov. 15, 1985

[51] Int. Cl.[4] ..... E06B 3/30; E04C 2/38

[52] U.S. Cl. ..... 52/456; 52/507; 52/717.1; 411/461; 411/477

[58] Field of Search ..... 52/456, 455, 714, 507, 52/718.1, 717.1; 411/461, 477

[56] References Cited

U.S. PATENT DOCUMENTS

| | | | |
|---|---|---|---|
| 2,966,705 | 1/1961 | Massey | 52/714 X |
| 3,108,336 | 10/1963 | Tate | 52/456 X |
| 3,293,817 | 12/1966 | MacGregor | 52/456 |
| 3,504,468 | 4/1970 | Martin | 52/456 X |
| 3,686,814 | 8/1972 | Anderson | 52/456 |

FOREIGN PATENT DOCUMENTS

| | | | |
|---|---|---|---|
| 94240 | 9/1923 | Austria | 52/455 |
| 2313536 | 12/1976 | France | 52/202 |
| 1398186 | 6/1975 | United Kingdom | 52/717.1 |

*Primary Examiner*—Alfred C. Perham
*Attorney, Agent, or Firm*—Kinney & Lange

[57] ABSTRACT

The present invention is a fastener system and method of using a fastener for removably securing bar grilles in window and door frames. A fastener having a tip or point at one end is inserted between a glass and a frame. The fastener has a pair of fins extending substantially perpendicularly from one surface and away from the glass. When appropriate mechanical forces are applied, the fins are bendable toward each other and have a tendency to return to their approximate original position after the forces are released. A slot is provided in the surface of a bar grille which comes into contact with the glass. The bar grille is snapped on the fastener so that the fins are forced toward each other as they enter the slot and are hooked into position as the fins return to their approximate original position. The bar grille may be removed by pulling on the grille so that fins disengage from the slot. When the bar grille is removed from the window, the fastener remains between the glass and the frame thereby preventing inadvertent loss.

18 Claims, 9 Drawing Figures

GRILLE FASTENER SYSTEM AND METHOD OF USING THE SAME

BACKGROUND OF THE INVENTION

1. Field of the Invention

The present invention generally relates to window and door grilles, and more particularly is concerned with a fastener for removably securing grilles to windows and doors.

2. Description of the Prior Art

Removable window and door grilles have long been used to add charm and character to single-paned windows. The grilles are added to create a multi-paned or Colonial look in glass and have been manufactured to fit almost all varieties of windows and window panes in doors. Grilles have also been installed on sliding glass doors, windows in garage doors, etc.

Generally, the grilles, also known as bar grilles, are made from narrow hardwood strips or bars. The bars may also be made from soft woods or synthetic materials and are cut and manufactured in various profiles. The bars are notched and connected to create a two-dimensional lattice or grille. Grilles have been arranged in both rectangular and diamond patterns. Before installation, the grilles are painted or stained to match the window frame or door. After installation the grilles add a warm, inviting look to otherwise bland windows.

Grilles are secured against a pane of glass by grille fasteners. Criteria for grille fasteners includes ease of installation for the homeowner. The fastener should easily release the grille at desired times for cleaning the glass pane and the like. Also, the fastener should be as unnoticeable as possible so as not to detract from the appearance of the grille and window. Finally, the fastener must be as universal as possible to be compatible with the multitude of window and door designs. Several fasteners for securing the grilles have been developed. However, many of the existing concepts of known art are not effective or take away from the appearance of the grilles.

Two general types of grille fasteners have evolved. The first type is known as a sliding knife or sliding pin fastener. The sliding knife fastener, having a point or pin at one end, typically is inserted into a slot in the end of the grille bar. After the grille is installed against the window, the point or pin is pushed into the frame to secure the grille against the glass. While this type of fastener is versatile for wooden frames, several disadvantages are also present. First, ears or protrusions are required along the sides of such fasteners to provide an area to apply force when the pin is inserted into and removed from the window frames. Such ears are visible and detract from the apperance of the bar grille. Second, it can be difficult to push such fasteners into the window frame. Third, when the pin is pushed into the frame, it scars or damages the frame. Fourth, when the grille is removed from the windows, the fastener remains with the grille, but is loose and can be lost. Fifth, such fasteners usually are not suitable for vinyl or aluminum frame windows.

A variation of the sliding knife or sliding pin concept is a fastener which has a point or pin and which wraps around the grille bar (rather than being movable in a slot in the bar). The fastener is slid over the end of a bar and has a pair of arms which wraps around the bar. Ears project out from the arms to allow the fastener to be slid back and forth along the bar. Rather than being pushed into the frame, the point is slid between the frame and the glass. This type of fastener is more versatile and is usually easier to use than the original sliding knife fastener. However the arms which wrap around the bar ends are visible from both inside and outside of the window. Moreover, the ears which project out from the arms further detract from the appearance of the grille.

The second type of a grille fastener of the prior art is known as a "snap-in" fastener. A plastic or metal retainer or fastener is attached to the window frame at a desired position with a screw or pin. The retainer has arms which project perpendicularly from the glass surface. Once the retainer is in place, the grille bar is snapped into the retainer and held in place by the arms which wrap around the outside of the bar. The disadvantages of this concept are many. First, the snap-in fastener requires a great deal of time and skill to install. Second, the fastener is very visible from inside the window because of the arms which wrap around the grille bar. Third, some versions require a modification of the window frame. Fourth, this type of fastener is not versatile and requires a different size and design for each type of grille and window.

Consequently, a need exists for improvements in fasteners for removably securing grilles. The fasteners should be easy to install on all types of windows and doors and should be constructed so as not to take away from the charm and appearance of the bar grilles.

SUMMARY OF THE INVENTION

The present invention provides an economical and easily installed fastener for removably securing bar grilles to windows and doors. The fastener of the present invention is designed to fit all types of windows and doors. Installation of the present fastener is quick and simple and can be performed easily by laymen. The present grille fastener remains with the frame when the grille is removed, thereby eliminating the chance of the fastener being lost. Finally, the present fastener is not visible from the inside of the window and only slightly visible from the outside of the window, thereby not detracting from the appearance and charm of the bar grilles.

Accordingly, the present invention is a fastener system and method of using a fastener for removably securing bar grilles in window and door frames. A fastener having a tip or point at one end is inserted between a glass and a frame. The fastener has a pair of fins extending substantially perpendicularly from one surface and away from the glass. When appropriate mechanical forces are applied, the fins are bendable toward each other and have a tendency to return to their approximate original position after the forces are released. A slot is provided in the surface of a bar grille which comes into contact with the glass. The bar grille is snapped on the fastener so that the fins are forced toward each other as they enter the slot and are hooked into position as the fins return to their approximate original position. The bar grille may be removed by pulling on the grille so that fins disengage from the slot. When the bar grille is removed from the window, the fastener remains between the glass and the frame thereby preventing inadvertent loss.

DETAILED DESCRIPTION OF THE PREFERRED EMBODIMENTS

Figure 1:
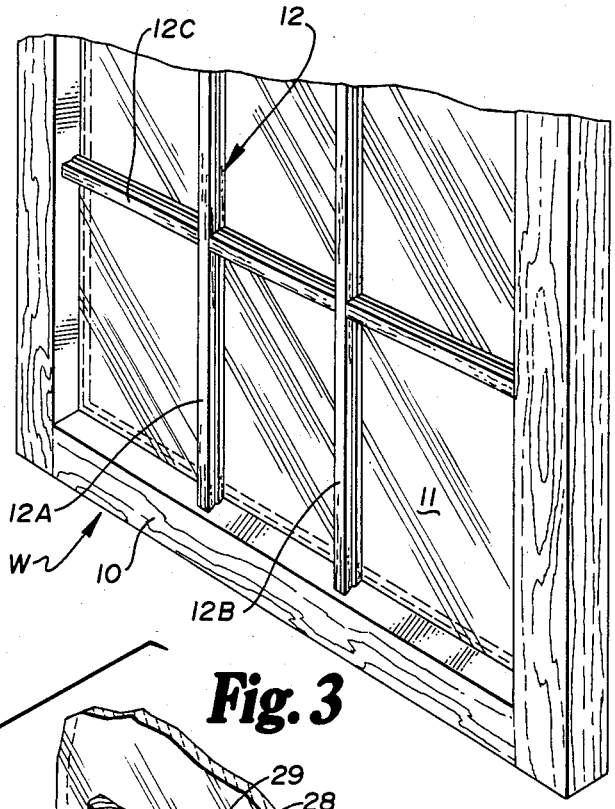
FIG. 1 is a perspective view from the inside of the lower portion of a typical window with a rectangular-patterned bar grille installed.

A typical window W is shown in FIG. 1. The view is from the inside of the window W and shows a single pane glass 11 mounted within a window frame 10. An insertable and removable bar grille 12 is shown mounted on the glass 11 and the window frame 10. Such a bar grille 12 may also be mounted on the glass of a door or other similar object. In FIG. 1, two vertical bars 12A and 12B and one horizontal bar 12C of bar grille 12 are shown. For illustration purposes only, the following drawings and description will refer only to a fastener of the present invention as used in window W. It will be understood that the fastener system described below can be utilized with window panes in doors, sliding glass doors and other panes enclosed in a frame.

Figure 2:
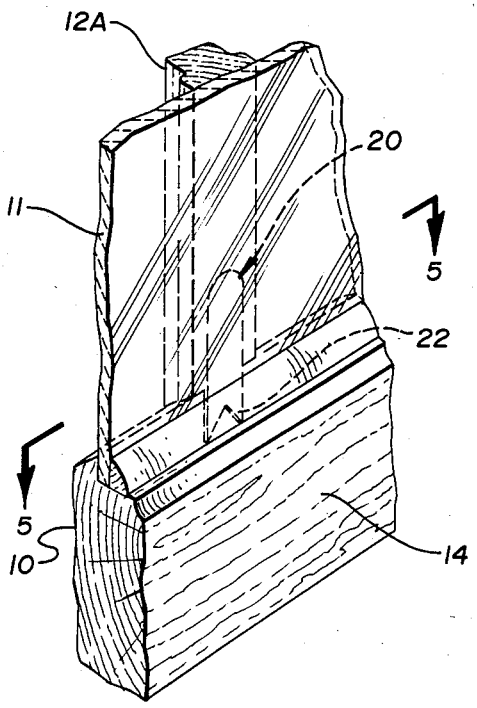
FIG. 2 is an enlarged perspective detail from the outside of a window of one grille bar and a fastener of the present invention mounted on a window frame.

FIG. 2 is an enlarged detail view taken from outside the window W of grille bar 12A mounted on the window W. It will be understood that the mounting of grille bar 12A is representative of the mounting of all of the bars of grille 12.

In FIG. 2, a tab member or fastener 20 of the present invention may be seen through the glass 11 at the point where the grille bar 12A engages the inside portion 10 of the window frame. The fastener 20 is a thin, longitudinal strip and has a smooth surface which contacts the glass. As seen through the outside portion 14 of the window frame in a dotted line view, the fastener 20 includes a pair of tips or points 22 at one end.

Figure 3:
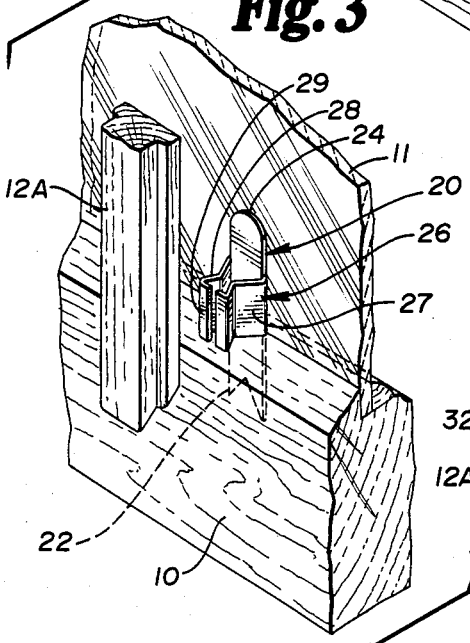
FIG. 3 is an exploded perspective view from inside of a window of a grille bar and a fastener of the present invention mounted on a window frame from inside of a window.
Figure 4:
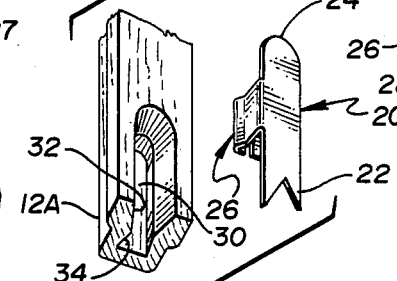
FIG. 4 is an exploded perspective view of a fastener of the present invention and showing the cooperating slot in a grille bar.
Figure 5:
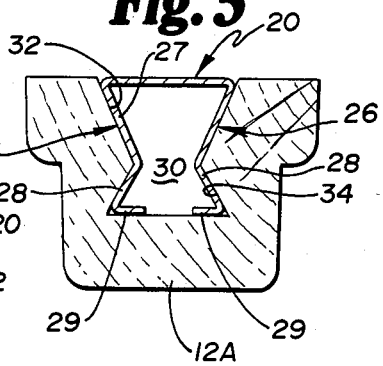
FIG. 5 is an enlarged top plan sectional view taken along line 5—5 of FIG. 2 with the window frame and glass omitted.

As can best be seen in the exploded perspective view of FIG. 3, the tips 22 of fastener 20 are inserted between the glass 11 and the inside portion of the window frame 10, thereby securing the fastener 20 in place. A tail portion 24 is provided at the end of the fastener 20 opposite the tips 22. As can be seen in FIGS. 3, 4 and 5, a pair of fins or appendages 26 located between the tips 22 and the tail 24 project substantially perpendicularly from the inner surface of the fastener 20. As shown best in FIG. 5, each fin 26 includes a lower portion 27 converging toward the opposite fin 26 and an upper portion 28 diverging away from the opposite fin 26. To prevent the fin 26 from ending in a sharp edge, the extreme outer portion 29 of each fin 26 may be bent inwardly to form a lip.

When mechanical forces are applied to the surfaces of the fins 26 so that the fins 26 are forced toward each other, the fins 26 are bendable toward each other. When the mechanical forces are released, the fins 26 bend or spring back to their approximate original positions.

It is preferred that the fastener 20 be constructed of a lightweight and durable material. If a metal is selected, the fastener 20 is preferably punched or stamped from a sheet. The fins 26 are bent to their proper positions and crimped to produce the portions 27, 28 and 29 described above. If a plastic material is selected, the fastener 20 is molded to the described shape.

Figure 7:
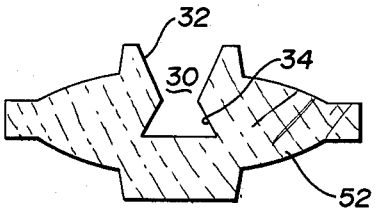
FIG. 7 is a sectional view of a third alternate bar grille profile showing the cooperating slot of the present invention.
Figure 6:
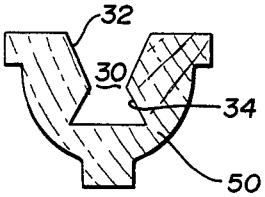
FIG. 6 is a sectional view of an alternate second bar grille profile showing the cooperating slot of the present invention.

As shown in FIG. 4, a groove or slot 30 is provided on the surface of the grille bar 12A which comes into contact with the glass 11. The slot 30 is cut into the end of the grille bar 12A in the area that will come into contact with the fins 26. As shown in FIGS. 4 and 5, and in the alternate profiles 50 and 52 of grille bars in FIGS. 6 and 7, respectively, a corresponding slot 30 provided in the grille bar 12A, 50 and 52 includes side portions 32 and 34 which align with and are complementary to the side portions 27 and 28, respectively, of the fins 26. The outer portions 32 of the slot 30 are cut inwardly at a corresponding angle to the lower side portions 27 of the fins 26. The inner portion 34 of the slot 30 is cut outwardly so as to receive the upper portions 28 of the fins 26. This complementary arrangement of the fin side portions 27 and 28 and slot side portions 32 and 34 allows the grille bar 12A, 50 and 52 to be snapped onto the fins 26 and locked into place. As the fins 26 enter the slot 30, the upper portions 28 of the fins 26 engage the outer portions 32 of the slot 30. The fins 26 are forced toward each other until the upper portions 28 of the fins 26 enter the inner portions 34 of the slot 30, wherein the fins 26 bend or spring back to their approximate original positions. The slot 30 conforms to the outline of the fins 26 and secures the grille bar 12A, 50 and 52 in place.

To secure the fastener 20 along the window frame 10, the bar grille 12 is placed on the inner surface of the glass 11 at the desired position. The installer marks the points where the grille bars 12A, 12B, 12C, etc. contact the inside portion of the window frame 10. Then the bar grille 12 is removed from the glass surface 11 and the tab member or fastener 20 is positioned at the mark. The fastener 20 is placed with the points or tips 22 pointing at the frame 10 along the glass 11. Using a pencil or grille bar or other suitable means for applying a force across the top of the fins 26, the installer pushes so that the fastener 20 is inserted between the glass 11 and the window frame 10. To install a complete bar grille 12, a fastener 20 is inserted at every desired point where the grille bars 12A, 12B, 12C etc. contact the frame 10.

Once the fastener 20 is inserted, the bar 12A having a corresponding slot 30 is snapped over the fins 26. After the bar 12A is snapped over the fins 26, the bar 12A is held in place against the window 11.

To remove the bar grille 12 for cleaning and the like, the grille 12 is pulled outwardly and perpendicularly from the glass surface 11. As the bar grille 12 is pulled, the fins 26 are forced inwardly and are released from the slot 30. The fasteners 20 remain in place along the glass surface 11.

In an alternate embodiment, the fins 26 may be replaced by a suitable similar means which projects outwardly from the fastener 20. Such means should be compressable as it enters the slot 30, and also capable of locking the grille in place once the means is received at the deepest point of the slot 30. The slot 30 can be of any shape or cut so long as it corresponds to the shape of the projection means and is capable of being cut in alternate grille bar profiles.

Described in other words, the fins 26 may be replaced with a suitable male locking means which extends substantially perpendicularly from the plane of the fastener 20. The male locking means must be resilient or yieldable as it enters a suitable female receptive means provided in the surface of a grille bar 12A which contacts the glass 11. Once the male locking means has entered the female receptive means, the grille bar 12A is locked or secured on the fastener 20. To remove the grille bar 12A, the bar 12A is pulled away from the glass 11 so that the male locking means having a resilient or yieldable tip is disengaged from the female receptive means.

Figures 8, 9:
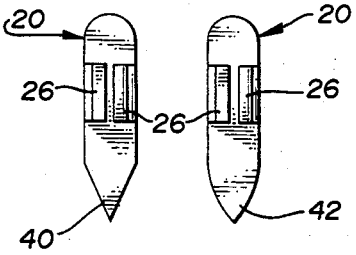
FIG. 8 is an inside plan view of a second alternate fastener of the present invention having a straight point profile.
FIG. 9 is an inside plan view of a third alternate fastener of the present invention having a convex point profile.

As shown in FIGS. 8 and 9, the fastener 20 may include alternate tip 22 arrangements. Tips such as a straight point 40 or a convex point 42 can be provided for insertion between the frame 10 and the glass 11.

Improvements of the present fastener over the prior art include ease of installation and the fact that the fastener remains with the window frame before and after the bar grille is installed. Also, the fastener 20 does not damage the inside of the window frame. As can be seen in FIG. 1, the fastener is not visible from the inside of the window frame. As shown in FIG. 2, only a small portion near the base of the window frame is visible. To reduce the visibility of the exposed portion of the fastener 20, the surface of the fastener which comes into contact with the glass 11 is painted or otherwise colored a color similar to the bar grille 12 before installation. Therefore, the exposed area of the fastener 20 blends with the bar grille and is even less noticeable.

Although the present invention has been described with reference to preferred embodiments, workers skilled in the art will recognize that changes may be made in form and detail without departing from the spirit and scope of the invention.

What is claimed is:

1. A system for removably securing a grille bar along an inner surface of a glass pane in a frame comprising:

(a) a tab member comprising a tip means inserted between the inner surface of the glass pane and the frame, and a male means, extending substantially perpendicularly from a plane of the tab member, the male means being compressable when a suitable mechanical force is applied and expandable to its approximate original shape when the mechanical force is released; and (b) female means in a portion of a first surface of the grille bar which engages the male means so that the first surface of the grille bar contacts the inner surface of the glass pane and is constructed in such a manner that the female means is visible only from the first surface of the grille bar.

2. A system as recited in claim 1 wherein the female means comprises a slot means constructed and arranged to conform to the outline of the male means.

3. A method of removably securing a grille bar against a glass pane in a frame comprising:

(a) inserting a tip of a tab member between the glass pane and the frame, the tab having a pair of fins extending substantially perpendicularly from one surface of the tab and away from the glass pane;

(b) aligning a slot in a surface of a grille bar which contacts the glass pane with the fins, the slot being constructed and arranged to receive the fins of the tab member; and (c) applying force to the grille bar to snap the slot over the fins of the tab member so that the fins are removably locked in the slot.

4. The method of removably securing a grille bar as recited in claim 7 wherein the tab member has a surface which faces the glass pane which is a color substantially similar to a color of the surface of the grille bar which contacts the glass pane.

5. The method of removably securing a grille bar as recited in claim 3 wherein a grille bar is removed from the glass pane by pulling the grille bar away from the glass pane so that the fins are disengaged from the slot, leaving the tab member intact with the tip between the glass pane and the frame.

6. The method of removably securing a grille bar as recited in claim 3 wherein the tip of the tab member includes a plurality of points.

7. In combination:

a glass pane in a frame;

a grille bar;

fastener means comprising tip reans at one end for insertion between the glass pane and the frame and a male locking means projecting substantially perpendicularly from a plane of the fastener means away from the glass pane at a suitable distance from the tip means;

female receptive means, provided at a end of the grille bar in a surface that engages the glass pane;

whereby, after the fastener means is inserted between the frame and glass pane, the grille bar is placed against the glass pane in such a manner that the male locking means of the fastener means is forced into the female receptive means of the grille bar thereby removably securing the grille bar against the glass pane.

8. The invention of claim 7 wherein the male locking means comprises at least one projection being fixed at a first end to the fastener means and having a resilient tip at a second end.

9. The invention of claim 7 wherein the fastener means comprises a longitudinal planar member.

10. The invention of claim 7 wherein the tip means includes at least one point.

11. The invention of claim 7 whereinthe female receptive means comprises a groove cut into the surface of the bar grille that contacts the glass pane, the groove being of such shape that the male locking means is removably retained in the groove after the male locking mean has entered the groove.

12. In a window, the combination comprising:

(a) a pane of glass;

(b) a frame enclosing the pane;

(c) a grille bar placed against an inner surface of the pane, the ends of the grille bar extending to the frame;

(d) fastener means for removably locking a grille bar on the pane, the fastener means being inserted between the pane and the frame at the point where a bar extends to the frame;

(e) the fastener means having tip means for insertion between the pane and the frame and yieldable projection means, extending substantially perpendicularly to a plane of the fastener means away from the pane; and (f) the grille bar having slot means provided at the end of the grille bar in a surface that engages the inner surface of the pane, the slot means being of a complimentary shape to an outline of the projection means of the fastener means;

whereby the bar grille is removably secured against the pane when the slot means receives the projection means.

13. The combination as recited in claim 12 wherein the fastener means comprises a longitudinal planar member.

14. The combination as recited in claim 12 wherein the tip means includes at least one point.

15. The combination as recited in claim 12 wherein the projection means comprises a pair of fins, aligned on opposite sides of the fastener means, each fin having a lower portion converging toward the other fin and an upper portion diverging away from the other fin.

16. The combination as recited in claim 15 wherein an extreme upper portion of each fin is bent inwardly to form a lip.

17. The combination as recited in claim 15 wherein the slot means comprises a pair of side walls, each wall having an outer portion cut inwardly and an inner portion cut outwardly in such a manner that each side wall is complementary to the shape of each respective fin.

18. A system for removably securing a lattice of grille bars against a pane of glass in a frame where the lattice extends to the frame comprising:

(a) a plurality of fastener means inserted between the pane and the frame at desired positions where the lattice extends to the frame, each fastener means comprising tip means at one end for insertion between the glass pane and the frame and a male locking means projecting substantially perpendicularly from a plane of the fastener means away from the glass pane at a suitable distance from the tip means;

(b) a plurality of female receptive means provided at desired ends of the lattice in a surface of the lattice that engages the pane;

(c) whereby after the plurality of fastener means is inserted between the frame and the pane at desired positions, the lattice is aligned and a force applied so that the male locking means of the fastener means is forced into the female receptive means of the lattice thereby removably securing the lattice against the pane.

* * * * *